US007390162B2

(12) United States Patent
Awdalla

(10) Patent No.: US 7,390,162 B2
(45) Date of Patent: Jun. 24, 2008

(54) ROTARY RAM COMPRESSOR

(76) Inventor: Essam T. Awdalla, 2309 Myron Dr., Apt. F, Raleigh, NC (US) 27607

( * ) Notice: Subject to any disclaimer, the term of this patent is extended or adjusted under 35 U.S.C. 154(b) by 665 days.

(21) Appl. No.: 11/069,267

(22) Filed: Mar. 1, 2005

(65) Prior Publication Data

US 2006/0198730 A1 Sep. 7, 2006

(51) Int. Cl.
*F01D 5/03* (2006.01)

(52) U.S. Cl. ..... 415/20; 415/207

(58) Field of Classification Search ..... 415/120, 415/202, 203, 205, 206, 207; 416/178, 187, 416/186 R
See application file for complete search history.

(56) References Cited

U.S. PATENT DOCUMENTS 3,140,042 A * 7/1964 Fujii ..... 416/243
3,459,133 A * 8/1969 Scheffler ..... 415/200
4,165,950 A * 8/1979 Masai et al. ..... 416/178
4,227,868 A 10/1980 Nishikawa et al.
4,278,399 A 7/1981 Erickson
4,358,244 A 11/1982 Nishikawa et al.
5,192,193 A * 3/1993 Cooper et al. ..... 416/186 R
6,739,835 B2 5/2004 Kim

FOREIGN PATENT DOCUMENTS

DE 3243169 A1 5/1984
JP 354013002 A 1/1979
JP 355087894 A 7/1980
WO PCT/US00/17044 6/2000

* cited by examiner

*Primary Examiner*—Edward Look
*Assistant Examiner*—Devin Hanan

(57) ABSTRACT

A rotary ram compressor for use in gas turbine engines and the like, having a plurality of vanes attached to discs, with the opposing parts of each two adjacent vanes and the opposing parts of the disks' surfaces confined between the opposing parts of the surfaces of the two adjacent vanes defining a channel in-between. Each channel is formed of two successive freely communicating portions: a first diverging inlet portion; and a second constant cross-sectional area outlet portion. In operation, gases are rammed into the first diverging inlet portion of the channel and are gradually displaced to the second constant cross-sectional area outlet portion of the channel, while being diverged, resulting into a rise in the static pressure energy of the gases, followed by smoothening of the stream of flow of the pressurized gases within the second constant cross-sectional area outlet portion of the channel.

18 Claims, 4 Drawing Sheets

ROTARY RAM COMPRESSOR

FIELD OF THE INVENTION

The present invention relates to a rotary ram compressor and, more particularly, to a rotary ram compressor convenient for use in gas turbine engines and the like, and having improved channel configuration, which decreases the overall rise in the temperature of the pressurized gases provided by the compressor, and thus improving the operating efficiency of any subsequent compressor stage.

BACKGROUND OF THE INVENTION

Rotary ram compressors are disclosed in the inventor's earlier International Patent Application serial number: PCT/US00/17044, entitled "Rotary ram fluid pressurizing machine", wherein the phenomenon of ram pressure rise, which occurs when a gas is rammed into a suitably shaped diffuser moving at a high speed, is utilized to develop a pressure gradient between two points across a gas stream. In an exemplary embodiment, vanes attached to rotary disks form channels, which act as diffusers when the disks are rotated, wherein the kinetic energy of the rammed in gases relative to the moving channels is converted into a ram pressure rise.

As rotary ram compressors have no rubbing parts within them, so, they can be used in the applications wherein relatively high operating rotational speeds are needed, i.e. gas turbine engines and the like. In the before mentioned patent application, the diverging stream of the rammed-in gases are admitted directly from the channels to the relatively inner (or outer) part of the compressor's rotor. The admission of a diverging stream of gases will be associated with turbulence of the gases at the point of admission, which leads to an additional increase in the temperature of pressurized gases supplied by the compressor, and thus decreasing the operating efficiency of any following compressor stage.

Thus, there is a need for a rotary ram compressor having improved channel configuration, which decreases the overall rise in the temperature of gases during the compression process, and thus improving the operating efficiency of any subsequent compressor stage.

Prior art made of record, which is not relied upon, includes U.S. Pat. No. 4,227,868 by Nishikawa et al., U.S. Pat. No. 4,278,399 by Erickson, U.S. Pat. No. 4,358,244 by Nishikawa et al., U.S. Pat. No. 6,739,835 by Kim, Japan Pat. No. JP354013002A, Japan Pat. No. JP35508794A, and German Pat. No. DE3243169A1. Each of them showing a compressor impeller having a first disk and a second disk and a plurality of vanes arranged there-between,

SUMMARY OF THE INVENTION

Accordingly, the present invention provides a rotary ram compressor having improved channel configuration, which decreases the overall rise in the temperature of the pressurized gases provided by the compressor, and thus improving the operating efficiency of any subsequent compressor stage.

In a preferred embodiment, the rotary ram compressor comprises a stationary casing having an inlet passage for admission of gases and an exit passage for discharge of the pressurized gases; a drive shaft supported by an arrangement of bearings, for rotation in a given direction inside the casing and extending to a drive receiving end located outside the casing; and a rotor assembly housed inside the casing. The rotor assembly includes a first disk surrounding the drive shaft and lying in a first plane transverse to the rotational axis of the drive shaft, a second disk surrounding the drive shaft and lying in a second plane transverse to the rotational axis of the drive shaft and axially spaced from the first plane, with either both of the disks being secured for rotation with the drive shaft, or only one of them secured for rotation with the drive shaft with the other one having a large open center and a widened rim, and with each of the disks having a relatively outer surface facing its adjacent part of the casing and a relatively inner surface, with the inner surfaces of the two disks defining an annular space in-between, and a plurality of vanes arranged circumferentially within the annular space defined in-between the inner surfaces of the disks. Each of the vanes has a first edge attached to the inner surface of the first disk, a second edge attached to the inner surface of the second disk, a relatively radially outward leading edge or tip and a relatively radially inward trailing edge or tail, with each vane curved preferably smoothly from its leading edge towards its trailing edge. The average angles of inclination of the successive portions of the vane with respect to a plane comprising the midpoint of the vane and perpendicular to a radial plane including the rotational axis of the rotor and the midpoint of the vane decreases preferably gradually from its leading edge towards its trailing edge, within a range from about +30 to about −48 degrees. Each vane has a concave displacing surface and a convex surface, with the opposing parts of the surfaces of each two adjacent vanes defining a channel between them, with the channel confined by a part of the concave surface of one vane and its opposing part of the convex surface of an adjacent vane. The rest of the concave surface freely communicates with the space relatively radially inward of the vanes, and the rest of the convex surface freely communicates with the space relatively radially outward of the vanes. Accordingly, the channel has an inlet communicating with the space relatively radially outward of the vanes, and an outlet communicating with the space relatively radially inward of the vanes. The boundaries of the channel are formed of the opposing parts of the surfaces of the two adjacent vanes and of the opposing parts of the disks' surfaces related to the channel and confined between the opposing parts of the surfaces of the two adjacent vanes. Each channel is formed of two successive freely communicating portions: a first diverging inlet portion; and a second constant cross-sectional area outlet portion, with the opposing surfaces defining the channel between them designed to provide this configuration.

The divergence of the first inlet portion of the channel is provided by designing the boundaries confining this portion of the channel between them so that: 1) the axial width of this portion of the channel, and/or 2) the width between the opposing parts of the surfaces of the two adjacent vanes confining this portion of the channel between them increase preferably gradually from the inlet of the channel towards its second constant cross-sectional area outlet portion, and hence, the cross-sectional area of the first inlet portion of the channel increases preferably gradually from its inlet towards the second constant cross-sectional area outlet portion of the channel.

The gradual increase in the axial width of the first inlet portion of the channel is provided by designing the part (s) of the surface (s) of one (or both) of the disks related to this portion of the channel and confined between the opposing parts of the surfaces of the two adjacent vanes so that it is sloping preferably gradually from the inlet of the channel towards its second constant cross-sectional area outlet portion. The gradual increase in the width between the opposing parts of the surfaces of the two adjacent vanes is provided by designing the vanes with suitable angles of inclination at their different parts, according to the desired rate of divergence of this channel portion described above.

In operation, the gases in the space relatively radially outward of the vanes are rammed into the first diverging inlet portions of the channels, formed in-between the circumferentially arranged vanes, and are gradually displaced to the second constant cross-sectional area outlet portions of the channels, while being diverged, resulting into a rise in the static pressure energy of the gases within the first diverging inlet portions of the channels. Then the pressurized gases are rammed into the second constant cross-sectional area outlet portions of the channels, wherein the stream of flow of the pressurized gases is smoothened, prior to its admission to the relatively inner part of the compressor's rotor confined by the vanes.

The gases are fed to the space relatively radially outward of the vanes through one or more than one inlet port (s) in the casing, and the pressurized gases are discharged through one or more than one opening (s) in either one or both of the disks, within the disk (s) portion confined between the vanes and the drive shaft, and communicating with the exit passage in the casing.

The resulting ram pressure rise depends on the speed of the vane leading edges, which depends on the rotational speed of the rotor assembly and its dimensions, noting that the speed of the vane leading edges must be kept within the subsonic range, to avoid the formation of shock waves, which if formed, will interfere with the feeding of the gases to the inlets of the channels confined between the vanes. Accordingly, the obtainable ram pressure rise from this embodiment will have a certain upper limit.

In another preferred embodiment, to further increase the obtainable static pressure rise, further vanes, arranged in one or more concentric sets, inward of the periphery, may be used, with the design and operation of the further vane sets being quite similar to those of the single stage embodiment discussed herein before, so that in operation, the gases in the space relatively radially inward of each of the vane sets are rammed into the inlets of the channels formed between the consequent set of vanes, and are gradually displaced to the space relatively radially inward of all the vane sets. The overall ram pressure rise in the space relatively radially inward of the innermost set of vanes will equal the multiplication of the ram pressure rises obtained from the successive concentric sets of vanes. Such arrangement is disclosed in the inventor earlier International Patent Application Number: PCT/US00/17044, and is well known by people experienced in the Art.

The volumetric capacity of the rotary ram compressor depends on the number of channels confined between the vanes, their dimensions, and the speed of the vanes leading edges. In another preferred embodiment, to increase the volumetric capacity without marked increase in the height of the vanes, to avoid the formation of excessive centrifugal and bending stresses one, or more than one, further circumferentially arranged vane level in axially stacked relation is used, with an intervening disk(s) between each two adjacent levels, with the attached edges of each of the vanes being attached to their related surfaces of the disks. The design and operation of the vanes of the further level(s) are quite similar to those of the single leveled embodiment, discussed herein before. Opening (s) in the intervening disk(s) portion confined between the circumferentially arranged vanes and the drive shaft may be provided, to functionally communicate the formed subspaces inside the rotor. One or more than one of the disks may be fixed to the casing, with the vane edges related to the fixed disk(s) being free, i.e., not attached to their related surface(s) of the disk(s). The fixed disk(s) may provide further support to the shaft through suitable arrangement of bearings in-between. Such arrangements are disclosed in the inventor earlier International Patent Application Number: PCT/US00/17044, and are well known by people experienced in the Art.

In another preferred embodiment, the rotary ram compressor comprises a stationary casing having an inlet passage for admission of gases and an exit passage for discharge of the pressurized gases; a drive shaft supported by an arrangement of bearings, for rotation in a given direction inside the casing and extending to a drive receiving end located outside the casing; and a rotor assembly housed inside the casing. The rotor assembly includes a first disk surrounding the drive shaft and lying in a first plane transverse to the rotational axis of the drive shaft, a second disk surrounding the drive shaft and lying in a second plane transverse to the rotational axis of the drive shaft and axially spaced from the first plane, with either both of the disks being secured for rotation with the drive shaft, or only one of them secured for rotation with the drive shaft with the other one having a large open center and a widened rim, and with each of the disks having a relatively outer surface facing its adjacent part of the casing and a relatively inner surface, with the inner surfaces of the two disks defining an annular space in-between, and a plurality of vanes arranged circumferentially within the annular space defined in-between the inner surfaces of the disks. Each of the vanes has a first edge attached to the inner surface of the first disk, a second edge attached to the inner surface of the second disk, a relatively radially inward leading edge or tip and a relatively radially outward trailing edge or tail, with each vane curved preferably smoothly from its leading edge towards its trailing edge. The average angles of inclination of the successive portions of the vane with respect to a plane comprising the midpoint of the vane and perpendicular to a radial plane including the rotational axis of the rotor and the midpoint of the vane decreases preferably gradually from its leading edge towards its trailing edge, within a range from about +48 to about −30 degrees. Each vane has a convex displacing surface and a concave surface, with the opposing parts of the surfaces of each two adjacent vanes defining a channel between them, with the channel confined by a part of the convex surface of one vane and its opposing part of the concave surface of an adjacent vane. The rest of the concave surface freely communicates with the space relatively radially inward of the vanes, and the rest of the convex surface freely communicates with the space relatively radially outward of the vanes. Accordingly, the channel has an inlet communicating with the space relatively radially inward of the vanes, and an outlet communicating with the space relatively radially outward of the vanes. The boundaries of the channel are formed of the opposing parts of the surfaces of the two adjacent vanes and of the opposing parts of the disks' surfaces related to the channel and confined between the opposing parts of the surfaces of the two adjacent vanes. Each channel is formed of two successive freely communicating portions: a first diverging inlet portion; and a second constant cross-sectional area outlet portion, with the opposing surfaces defining the channel between them designed to provide this configuration.

The divergence of the first inlet portion of the channel is provided by designing the boundaries confining this portion of the channel between them so that: 1) the axial width of this portion of the channel, and/or 2) the width between the opposing parts of the surfaces of the two adjacent vanes confining this portion of the channel between them increase preferably gradually from the inlet of the channel towards its second constant cross-sectional area outlet portion, and hence, the cross-sectional area of the first inlet portion of the channel increases preferably gradually from its inlet towards the second constant cross-sectional area outlet portion of the channel.

The gradual increase in the axial width of the first inlet portion of the channel is provided by designing the part (s) of the surface (s) of one (or both) of the disks related to this portion of the channel and confined between the opposing parts of the surfaces of the two adjacent vanes so that it is sloping preferably gradually from the inlet of the channel towards its second constant cross-sectional area outlet portion. The gradual increase in the width between the opposing parts of the surfaces of the two adjacent vanes is provided by designing the vanes with suitable angles of inclination at their different parts, according to the desired rate of divergence of this channel portion described above.

In operation, the gases in the space relatively radially inward of the vanes are rammed into the first diverging inlet portions of the channels, formed in-between the circumferentially arranged vanes, and are gradually displaced to the second constant cross-sectional area outlet portions of the channels, while being diverged, resulting into a rise in the static pressure energy of the gases within the diverging inlet portions of the channels. Then the pressurized gases are rammed into the second constant cross-sectional area outlet portions of the channels, wherein the stream of flow of the pressurized gases is smoothened prior to its admission to the relatively radially outward part of the compressor's rotor.

The gases are fed to the space relatively radially inward of the vanes through one or more than one inlet port (s) in the casing, and the pressurized gases are discharged through relatively radially outward exit passage(s) in the casing.

The resulting ram pressure rise depends on the speed of the vane leading edges, which depends on the rotational speed of the rotor assembly and its dimensions, noting that the speed of the vane leading edges must be kept within the subsonic range, to avoid the formation of shock waves, which if formed, will interfere with the feeding of the gases to the inlets of the channels confined between the vanes. Accordingly, the obtainable ram pressure rise from this embodiment will have a certain upper limit.

In another preferred embodiment, to further increase the obtainable static pressure rise, further vanes, arranged in one or more concentric sets, may be used, with the design and operation of the further vanes being quite similar to those of the single stage embodiment discussed herein before, so that in operation, the gases in the space relatively radially outward of each of the vane sets are rammed into the inlets of the channels formed between the consequent set of vanes, and are gradually displaced to the space relatively radially outward of all the vane sets. The overall ram pressure rise in the space relatively radially outward of the outermost set of vanes will equal the multiplication of the ram pressure rises obtained from the successive concentric sets of vanes. Such arrangement is disclosed in the inventor earlier International Patent Application Number: PCT/US00/17044, and is well known by people experienced in the Art.

The volumetric capacity of the rotary ram compressor depends on the number of channels confined between the vanes, their dimensions, and the speed of the vanes leading edges. In another preferred embodiment, to increase the volumetric capacity without marked increase in the height of the vanes, to avoid the formation of excessive centrifugal and bending stresses one, or more than one, further circumferentially arranged vane level in axially stacked relation is used, with an intervening disk(s) between each two adjacent levels, with the attached edges of each of the vanes being attached to their related surfaces of the disks. The design and operation of the vanes of the further level(s) are quite similar to those of the single leveled embodiment, discussed herein before. Opening (s) in the intervening disk(s) portion confined between the circumferentially arranged vanes and the drive shaft may be provided, to functionally communicate the formed subspaces inside the rotor. One or more than one of the disks may be fixed to the casing, with the vane edges related to the fixed disk(s) being free, i.e., not attached to their related surface(s) of the disk(s). The fixed disk(s) may provide further support to the shaft through suitable arrangement of bearings in-between. Such arrangements are disclosed in the inventor earlier International Patent Application Number: PCT/US00/17044, and are well known by people experienced in the Art.

In the previous embodiments, the attachment of the vane edges to their related surfaces of the disks may be by casting the disk integrally with the vanes, or by fastening the vanes to the disk by pressurized fitting of the vane edges into matching grooves in the related surface of the disk, by bolts, or the disk and vanes may be machined from a single forging. Such attachment means are well known to those of ordinary skill in the art.

Sealing means may be provided at one or more sites, in the clearance between the relatively inner surface of the stationary casing and its related opposing surface (s) of the disk (s) of the rotor assembly, to minimize or prevent the back flow of the pressurized gases from the exit passage (s) to the inlet passage (s). The sealing means may be of the contact or labyrinth type, according to the type of the gases being pressurized and the developed pressure gradient. Such sealing means are well known to those of ordinary skill in the art.

The rate of divergence of the first inlet portions of the channels, as well as the curvature of the vanes, is maintained within the practical limits preventing the separation of the rammed gases from the boundaries of the diverging inlet portions of the channels. Such practical limits depends on the type of the gases to be pressurized, and are well known to those of ordinary skill in the art.

As the reaction force of the gases acting on the displacing surface of each of the vanes can be resolved into two components; a radial component and a tangential component, relative to an imaginary circular plane intersecting the vane and concentric with the shaft of the rotor assembly, with the radial components of the reaction forces acting on the vanes of each of the sets being neutralized by one another, so, in operation, the power consumed by the rotor assembly is only utilized in overcoming the tangential components of the reaction forces acting on the displacing surfaces of the vanes.

Also, as minimal acceleration of the gases occurs within the channels, in the form of gradual displacement in either a relatively radially inward or a relatively radially outward direction, according to the type of the rotary ram compressor used, the resulting rise in the temperature of the pressurized gases will be minimal, with marked improvement in the efficiency of subsequent compression, when needed, and which also enables recovering more heat energy from the exhaust gases, when used in gas turbine engines provided with heat exchangers, which will decrease the overall heat energy emission from the power plant and improve its overall operating efficiency.

Any of the previous rotary ram compressor embodiments discussed herein before, can be used as a vacuum pump, to decrease the pressure of a gas inside a container, by freely communicating the exit passage of the rotary ram compressor to the surrounding atmosphere, and communicating its inlet passage(s) with the container. In operation, the gas inside the container is rammed out of it, through the channels confined between the vanes of the rotor assembly of the rotary ram compressor, and is discharged to the surrounding atmosphere, and thus, decreases the pressure of the gas inside the container.

BREIF DESCRIPTION OF THE DRAWINGS

The description of the objects, features and advantages of the present invention, will be more fully appreciated by reference to the following detailed description of the exemplary embodiments in accordance with the accompanying drawings, wherein.

DETAILED DESCRIPTION

Figure 1:
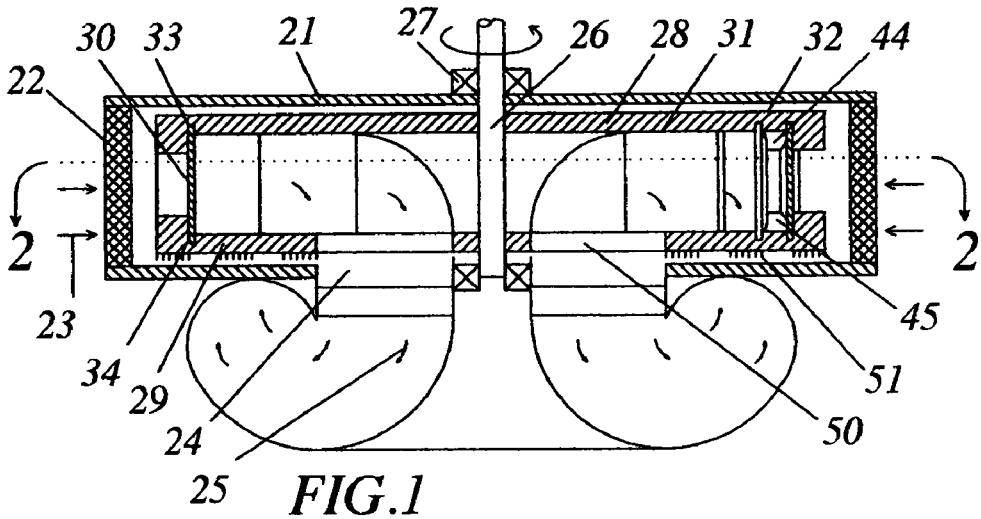
FIG. 1 is a sectional view in a schematic representation of an exemplary embodiment of a rotary ram compressor, in accordance with the present invention.

The present invention provides a rotary ram compressor having improved channel configuration, which decreases the overall rise in the temperature of the pressurized gases provided by the compressor, and thus improving the operating efficiency of any subsequent compressor stage.

In a preferred embodiment, the rotary ram compressor comprises a stationary casing having an inlet passage for admission of gases and an exit passage for discharge of the pressurized gases; a drive shaft supported by an arrangement of bearings, for rotation in a given direction inside the casing and extending to a drive receiving end located outside the casing; and a rotor assembly housed inside the casing. The rotor assembly includes a first disk surrounding the drive shaft and lying in a first plane transverse to the rotational axis of the drive shaft, a second disk surrounding the drive shaft and lying in a second plane transverse to the rotational axis of the drive shaft and axially spaced from the first plane, with either both of the disks being secured for rotation with the drive shaft, or only one of them secured for rotation with the drive shaft with the other one having a large open center and a widened rim, and with each of the disks having a relatively outer surface facing its adjacent part of the casing and a relatively inner surface, with the inner surfaces of the two disks defining an annular space in-between, and a plurality of vanes arranged circumferentially within the annular space defined in-between the inner surfaces of the disks. Each of the vanes has a first edge attached to the inner surface of the first disk, a second edge attached to the inner surface of the second disk, a relatively radially outward leading edge or tip and a relatively radially inward trailing edge or tail, with each vane curved preferably smoothly from its leading edge towards its trailing edge. The average angles of inclination of the successive portions of the vane with respect to a plane comprising the midpoint of the vane and perpendicular to a radial plane including the rotational axis of the rotor and the midpoint of the vane decreases preferably gradually from its leading edge towards its trailing edge, within a range from about +30 to about −48 degrees. Each vane has a concave displacing surface and a convex surface, with the opposing parts of the surfaces of each two adjacent vanes defining a channel between them, with the channel confined by a part of the concave surface of one vane and its opposing part of the convex surface of an adjacent vane. The rest of the concave surface freely communicates with the space relatively radially inward of the vanes, and the rest of the convex surface freely communicates with the space relatively radially outward of the vanes. Accordingly, the channel has an inlet communicating with the space relatively radially outward of the vanes, and an outlet communicating with the space relatively radially inward of the vanes. The boundaries of the channel are formed of the opposing parts of the surfaces of the two adjacent vanes and of the opposing parts of the disks' surfaces related to the channel and confined between the opposing parts of the surfaces of the two adjacent vanes. Each channel is formed of two successive freely communicating portions: a first diverging inlet portion; and a second constant cross-sectional area outlet portion, with the opposing surfaces defining the channel between them designed to provide this configuration.

The divergence of the first inlet portion of the channel is provided by designing the boundaries confining this portion of the channel between them so that: 1) the axial width of this portion of the channel, and/or 2) the width between the opposing parts of the surfaces of the two adjacent vanes confining this portion of the channel between them increase preferably gradually from the inlet of the channel towards its second constant cross-sectional area outlet portion, and hence, the cross-sectional area of the first inlet portion of the channel increases preferably gradually from its inlet towards the second constant cross-sectional area outlet-portion of the channel.

The gradual increase in the axial width of the first inlet portion of the channel is provided by designing the part (s) of the surface (s) of one (or both) of the disks related to this portion of the channel and confined between the opposing parts of the surfaces of the two adjacent vanes so that it is sloping preferably gradually from the inlet of the channel towards its second constant cross-sectional area outlet portion. The gradual increase in the width between the opposing parts of the surfaces of the two adjacent vanes is provided by designing the vanes with suitable angles of inclination at their different parts, according to the desired rate of divergence of this channel portion described above.

In operation, the gases in the space relatively radially outward of the vanes are rammed into the first diverging inlet portions of the channels, formed in-between the circumferentially arranged vanes, and are gradually displaced to the second constant cross-sectional area outlet portions of the channels, while being diverged, resulting into a rise in the static pressure energy of the gases within the first diverging inlet portions of the channels. Then the pressurized gases are rammed into the second constant cross-sectional area outlet portions of the channels, wherein the stream of flow of the pressurized gases is smoothened, prior to its admission to the relatively inner part of the compressor's rotor confined by the vanes.

The gases are fed to the space relatively radially outward of the vanes through one or more than one inlet port (s) in the casing, and the pressurized gases are discharged through one or more than one opening (s) in either one or both of the disks, within the disk (s) portion confined between the vanes and the drive shaft, and communicating with the exit passage in the casing.

The resulting ram pressure rise depends on the speed of the vane leading edges, which depends on the rotational speed of the rotor assembly and its dimensions, noting that the speed of the vane leading edges must be kept within the subsonic range, to avoid the formation of shock waves, which if formed, will interfere with the feeding of the gases to the inlets of the channels confined between the vanes. Accordingly, the obtainable ram pressure rise from this embodiment will have a certain upper limit.

In another preferred embodiment, to further increase the obtainable static pressure rise, further vanes, arranged in one or more concentric sets, inward of the periphery, may be used, with the design and operation of the further vane sets being quite similar to those of the single stage embodiment discussed herein before, so that in operation, the gases in the space relatively radially inward of each of the vane sets are rammed into the inlets of the channels formed between the consequent set of vanes, and are gradually displaced to the space relatively radially inward of all the vane sets. The overall ram pressure rise in the space relatively radially inward of the innermost set of vanes will equal the multiplication of the ram pressure rises obtained from the successive concentric sets of vanes. Such arrangement is disclosed in the inventor earlier International Patent Application Number: PCT/US00/17044, and is well known by people experienced in the Art.

The volumetric capacity of the rotary ram compressor depends on the number of channels confined between the vanes, their dimensions, and the speed of the vanes leading edges. In another preferred embodiment, to increase the volumetric capacity without marked increase in the height of the vanes, to avoid the formation of excessive centrifugal and bending stresses one, or more than one, further circumferentially arranged vane level in axially stacked relation is used, with an intervening disk(s) between each two adjacent levels, with the attached edges of each of the vanes being attached to their related surfaces of the disks. The design and operation of the vanes of the further level(s) are quite similar to those of the single leveled embodiment, discussed herein before. Opening (s) in the intervening disk(s) portion confined between the circumferentially arranged vanes and the drive shaft may be provided, to functionally communicate the formed subspaces inside the rotor. One or more than one of the disks may be fixed to the casing, with the vane edges related to the fixed disk(s) being free, i.e., not attached to their related surface(s) of the disk(s). The fixed disk(s) may provide further support to the shaft through suitable arrangement of bearings in-between. Such arrangements are disclosed in the inventor earlier International Patent Application Number: PCT/US00/17044, and are well known by people experienced in the Art.

In another preferred embodiment, the rotary ram compressor comprises a stationary casing having an inlet passage for admission of gases and an exit passage for discharge of the pressurized gases; a drive shaft supported by an arrangement of bearings, for rotation in a given direction inside the casing and extending to a drive receiving end located outside the casing; and a rotor assembly housed inside the casing. The rotor assembly includes a first disk surrounding the drive shaft and lying in a first plane transverse to the rotational axis of the drive shaft, a second disk surrounding the drive shaft and lying in a second plane transverse to the rotational axis of the drive shaft and axially spaced from the first plane, with either both of the disks being secured for rotation with the drive shaft, or only one of them secured for rotation with the drive shaft with the other one having a large open center and a widened rim, and with each of the disks having a relatively outer surface facing its adjacent part of the casing and a relatively inner surface, with the inner surfaces of the two disks defining an annular space in-between, and a plurality of vanes arranged circumferentially within the annular space defined in-between the inner surfaces of the disks. Each of the vanes has a first edge attached to the inner surface of the first disk, a second edge attached to the inner surface of the second disk, a relatively radially inward leading edge or tip and a relatively radially outward trailing edge or tail, with each vane curved preferably smoothly from its leading edge towards its trailing edge. The average angles of inclination of the successive portions of the vane with respect to a plane comprising the midpoint of the vane and perpendicular to a radial plane including the rotational axis of the rotor and the midpoint of the vane decreases preferably gradually from its leading edge towards its trailing edge, within a range from about +48 to about −30 degrees. Each vane has a convex displacing surface and a concave surface, with the opposing parts of the surfaces of each two adjacent vanes defining a channel between them, with the channel confined by a part of the convex surface of one vane and its opposing part of the concave surface of an adjacent vane. The rest of the concave surface freely communicates with the space relatively radially inward of the vanes, and the rest of the convex surface freely communicates with the space relatively radially outward of the vanes. Accordingly, the channel has an inlet communicating with the space relatively radially inward of the vanes, and an outlet communicating with the space relatively radially outward of the vanes. The boundaries of the channel are formed of the opposing parts of the surfaces of the two adjacent vanes and of the opposing parts of the disks' surfaces related to the channel and confined between the opposing parts of the surfaces of the two adjacent vanes. Each channel is formed of two successive freely communicating portions: a first diverging inlet portion; and a second constant cross-sectional area outlet portion, with the opposing surfaces defining the channel between them designed to provide this configuration.

The divergence of the first inlet portion of the channel is provided by designing the boundaries confining this portion of the channel between them so that: 1) the axial width of this portion of the channel, and/or 2) the width between the opposing parts of the surfaces of the two adjacent vanes confining this portion of the channel between them increase preferably gradually from the inlet of the channel towards its second constant cross-sectional area outlet portion, and hence, the cross-sectional area of the first inlet portion of the channel increases preferably gradually from its inlet towards the second constant cross-sectional area outlet portion of the channel.

The gradual increase in the axial width of the first inlet portion of the channel is provided by designing the part (s) of the surface (s) of one (or both) of the disks related to this portion of the channel and confined between the opposing parts of the surfaces of the two adjacent vanes so that it is sloping preferably gradually from the inlet of the channel towards its second constant cross-sectional area outlet portion. The gradual increase in the width between the opposing parts of the surfaces of the two adjacent vanes is provided by designing the vanes with suitable angles of inclination at their different parts, according to the desired rate of divergence of this channel portion described above.

In operation, the gases in the space relatively radially inward of the vanes are rammed into the first diverging inlet portions of the channels, formed in-between the circumferentially arranged vanes, and are gradually displaced to the second constant cross-sectional area outlet portions of the channels, while being diverged, resulting into a rise in the static pressure energy of the gases within the diverging inlet portions of the channels. Then the pressurized gases are rammed into the second constant cross-sectional area outlet portions of the channels, wherein the stream of flow of the pressurized gases is smoothened prior to its admission to the relatively radially outward part of the compressor's rotor.

The gases are fed to the space relatively radially inward of the vanes through one or more than one inlet port (s) in the casing, and the pressurized gases are discharged through relatively radially outward exit passage(s) in the casing.

The resulting ram pressure rise depends on the speed of the vane leading edges, which depends on the rotational speed of the rotor assembly and its dimensions, noting that the speed of the vane leading edges must be kept within the subsonic range, to avoid the formation of shock waves, which if formed, will interfere with the feeding of the gases to the inlets of the channels confined between the vanes. Accordingly, the obtainable ram pressure rise from this embodiment will have a certain upper limit.

In another preferred embodiment, to further increase the obtainable static pressure rise, , further vanes, arranged in one or more concentric sets, may be used, with the design and operation of the further vanes being quite similar to those of the single stage embodiment discussed herein before, so that in operation, the gases in the space relatively radially outward of each of the vane sets are rammed into the inlets of the channels formed between the consequent set of vanes, and are gradually displaced to the space relatively radially outward of all the vane sets. The overall ram pressure rise in the space relatively radially outward of the outermost set of vanes will equal the multiplication of the ram pressure rises obtained from the successive concentric sets of vanes. Such arrangement is disclosed in the inventor earlier International Patent Application Number: PCT/US00/17044, and is well known by people experienced in the Art.

The volumetric capacity of the rotary ram compressor depends on the number of channels confined between the vanes, their dimensions, and the speed of the vanes leading edges. In another preferred embodiment, to increase the volumetric capacity without marked increase in the height of the vanes, to avoid the formation of excessive centrifugal and bending stresses one, or more than one, further circumferentially arranged vane level in axially stacked relation is used, with an intervening disk(s) between each two adjacent levels, with the attached edges of each of the vanes being attached to their related surfaces of the disks. The design and operation of the vanes of the further level(s) are quite similar to those of the single leveled embodiment, discussed herein before. Opening (s) in the intervening disk(s) portion confined between the circumferentially arranged vanes and the drive shaft may be provided, to functionally communicate the formed subspaces inside the rotor. One or more than one of the disks may be fixed to the casing, with the vane edges related to the fixed disk(s) being free, i.e., not attached to their related surface(s) of the disk(s). The fixed disk(s) may provide further support to the shaft through suitable arrangement of bearings in-between. Such arrangements are disclosed in the inventor earlier International Patent Application Number: PCT/US00/17044, and are well known by people experienced in the Art.

In the previous embodiments, the attachment of the vane edges to their related surfaces of the disks may be by casting the disk integrally with the vanes, or by fastening the vanes to the disk by pressurized fitting of the vane edges into matching grooves in the related surface of the disk, by bolts, or the disk and vanes may be machined from a single forging. Such attachment means are well known to those of ordinary skill in the art.

Sealing means may be provided at one or more sites, in the clearance between the relatively inner surface of the stationary casing and its related opposing surface (s) of the disk (s) of the rotor assembly, to minimize or prevent the back flow of the pressurized gases from the exit passage (s) to the inlet passage (s). The sealing means may be of the contact or labyrinth type, according to the type of the gases being pressurized and the developed pressure gradient. Such sealing means are well known to those of ordinary skill in the art.

The rate of divergence of the first inlet portions of the channels, as well as the curvature of the vanes, is maintained within the practical limits preventing the separation of the rammed gases from the boundaries of the diverging inlet portions of the channels. Such practical limits depends on the type of the gases to be pressurized, and are well known to those of ordinary skill in the art.

As the reaction force of the gases acting on the displacing surface of each of the vanes can be resolved into two components; a radial component and a tangential component, relative to an imaginary circular plane intersecting the vane and concentric with the shaft of the rotor assembly, with the radial components of the reaction forces acting on the vanes of each of the sets being neutralized by one another, so, in operation, the power consumed by the rotor assembly is only utilized in overcoming the tangential components of the reaction forces acting on the displacing surfaces of the vanes.

Also, as minimal acceleration of the gases occurs within the channels, in the form of gradual displacement in either a relatively radially inward or a relatively radially outward direction, according to the type of the rotary ram compressor used, the resulting rise in the temperature of the pressurized gases will be minimal, with marked improvement in the efficiency of subsequent compression, when needed, and which also enables recovering more heat energy from the exhaust gases, when used in gas turbine engines provided with heat exchangers, which will decrease the overall heat energy emission from the power plant and improve its overall operating efficiency.

Any of the previous rotary ram compressor embodiments discussed herein before, can be used as a vacuum pump, to decrease the pressure of a gas inside a container, by freely communicating the exit passage of the rotary ram compressor to the surrounding atmosphere, and communicating its inlet passage(s) with the container. In operation, the gas inside the container is rammed out of it, through the channels confined between the vanes of the rotor assembly of the rotary ram compressor, and is discharged to the surrounding atmosphere, and thus, decreases the pressure of the gas inside the container.

FIG. 1 is a sectional view in a schematic representation of an exemplary embodiment of a rotary ram compressor, in accordance with the present invention.

Figure 2:
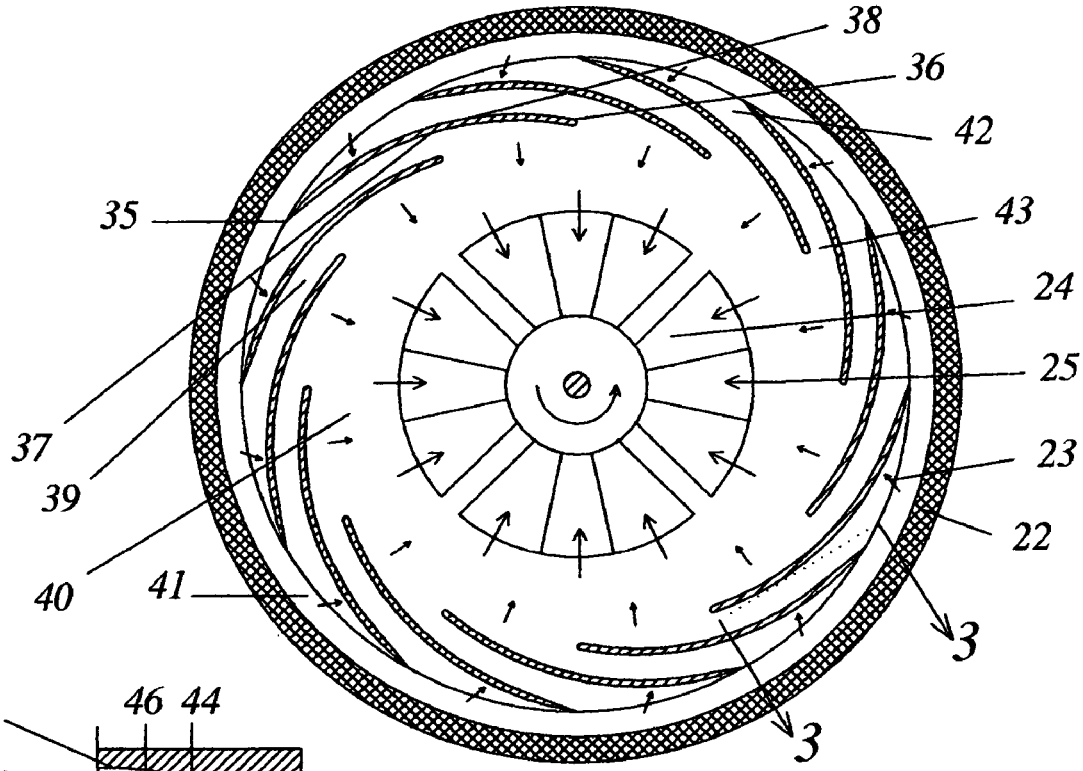
FIG. 2 is a cross sectional view, taken at the plane of line 2-2 in FIG. 1.
Figure 3:
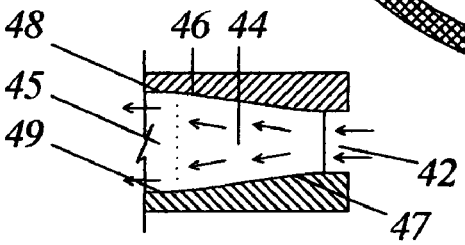
FIG. 3 is a cross sectional view, taken at the plane of line 3-3 in FIG. 2.

The main components of the rotary ram compressor in this embodiment are a stationary casing 21 having an inlet passage 22 for admission of gases 23, provided with means for filtering the incoming gases, and an exit passage 24 for discharge of the pressurized gases 25; a drive shaft 26 supported for rotation in a given direction inside the casing by an arrangement of bearings 27, and extending to a drive receiving end located outside the casing; and a rotor assembly housed inside the casing. The rotor assembly includes a first disk 28, a second disk 29, and a plurality of vanes 30 arranged circumferentially within the annular space defined in-between the relatively inner surfaces of the disks, with both of the disks being secured for rotation with the drive shaft. Each of the disks has a relatively inner surface 31, forming one of the boundaries of the space confined inside the rotor, and a relatively outer surface 32 facing its adjacent part of the casing. Each of the circumferentially arranged vanes has a first edge 33 attached to the inner surface of the first disk, a second edge 34 attached to the inner surface of the second disk. As shown in FIG. 2 which is a cross sectional view, taken at the plane of line 2-2 in FIG. 1, each of the vanes has a relatively radially outward leading edge or tip 35, and a relatively radially inward trailing edge or tail 36. Each vane is preferably smoothly curved from its leading edge 35 towards its trailing edge 36. The average angles of inclination of the successive portions of the vane with respect to a plane comprising the midpoint of the vane and perpendicular to a radial plane including the rotational axis of the rotor and the midpoint of the vane decreases gradually from its leading edge towards its trailing edge, within a range from about +28 to about −28 degrees. Each vane has a concave displacing surface 37 and a convex surface 38, with the opposing parts of the surfaces of each two adjacent vanes defining a channel 39 between them. The channel is confined by a part of the concave surface of one vane and its opposing part of the convex surface of its adjacent vane. The rest of the concave surface freely communicates with the space 40 relatively radially inward of the vanes, and the rest of the convex surface freely communicates with the space 41 relatively radially outward of the vanes. The channel has an inlet 42 communicating with the space relatively radially outward of the vanes, and an outlet 43 communicating with the space relatively radially inward of the vanes. The boundaries of the channel are formed of the opposing parts of the surfaces of the two adjacent vanes and of the two opposing parts of the inner surfaces of the disks related to the channel and confined between the opposing parts of the surfaces of the two adjacent vanes. As shown in FIG. 3 which is a cross sectional view, taken at the plane of line 3-3 in FIG. 2, each channel is formed of two successive freely communicating portions: a first diverging inlet portion 44; and a second constant cross-sectional area outlet portion 45, with the opposing parts of the inner surfaces of the disks related to the first diverging inlet portion of the channel 46, 47 being sloped, so that the axial width of the first diverging inlet portion of the channel increases gradually from the inlet of the channel 42 towards its second constant cross-sectional area outlet portion 45. Accordingly, the channel diverges from its inlet 42 towards its second constant cross-sectional area outlet portion 45. The opposing parts of the inner surfaces of the disks 48, 49 related to the second constant cross-sectional area outlet portion of the channel, as well as the related opposing parts of the vanes, are parallel to one another, so that the second outlet portion 45 of the channel has constant cross-sectional area.

In operation, the gases in the space 41 relatively radially outward of the vanes are rammed into the channels 39 confined in-between the opposing parts of the surfaces of the circumferentially arranged vanes, and are gradually displaced to the space 40 relatively radially inward of the vanes. Within the channels, the rammed in gases are diverged within the first diverging inlet portions of the channels 44, resulting in a rise in the static pressure energy of the gases, followed by smoothening of the stream of flow of the pressurized gases within the second constant cross sectional area outlet portions of the channels 45, prior to its admission to the space 40 relatively radially inward of the vanes.

The pressurized gases are discharged through openings 50 in one of the disks 29, within the disk's portion confined between the vanes 30 and the drive shaft 26, and communicating with the exit passage in the casing 21. Labyrinth sealing 51 is provided in the clearance between the outer surface 32 of the second disk and its opposing inner surface of the stationary casing, to minimize the back flow of the pressurized gases from the exit passage 24 to the inlet passage 22.

The resulting ram pressure rise in this embodiment depends on the speed of the vane leading edges 35, which depends on the rotational speed of the rotor assembly, and its dimensions. The speed of the vane leading edges must be kept within the subsonic range, to avoid the formation of shock waves, which if formed, will interfere with the feeding of the gases to the inlets 42 of the channels 39.

Figure 4:
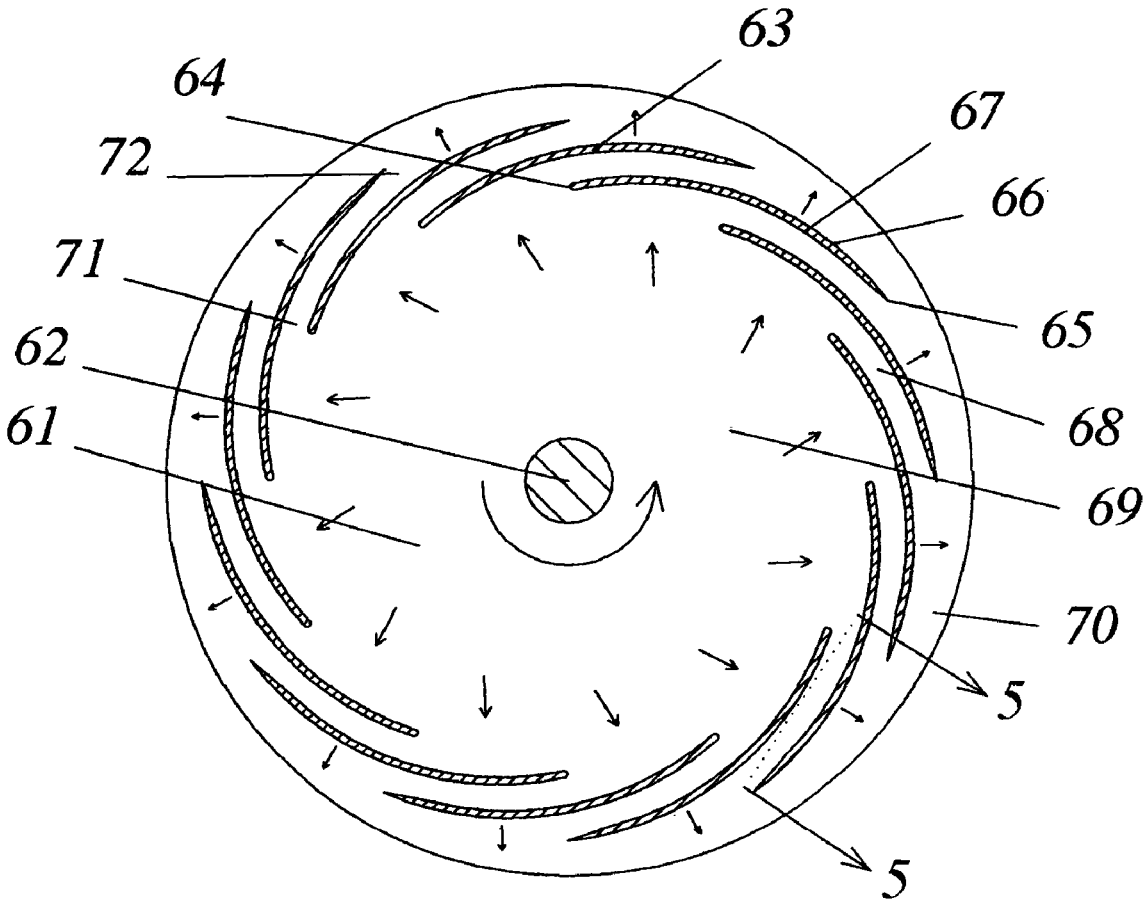
FIG. 4 is a sectional view in a schematic representation of the rotor of another exemplary embodiment of a rotary ram compressor, in accordance with the present invention.

FIG. 4 is a sectional view in a schematic representation of the rotor assembly of another exemplary embodiment of a rotary ram compressor, in accordance with the present invention.

Figure 5:
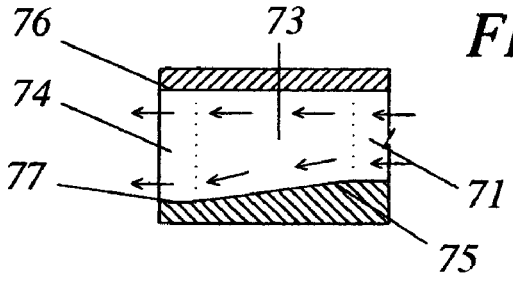
FIG. 5 is a cross sectional view, taken at the plane of line 5-5 in FIG. 4.

The rotor assembly includes a first disk (not shown in the drawing), a second disk 61 secured for rotation with a drive shaft 62, and a plurality of vanes 63 arranged circumferentially within the annular space defined in-between the relatively inner surfaces of the disks. Each of the circumferentially arranged vanes has a relatively radially inward leading edge or tip 64, and a relatively radially outward trailing edge or tail 65. Each vane is preferably smoothly curved from its leading edge 64 towards its trailing edge 65. The average angles of inclination of the successive portions of the vane with respect to a plane comprising the midpoint of the vane and perpendicular to a radial plane including the rotational axis of the rotor and the midpoint of the vane decreases gradually from its leading edge towards its trailing edge, within a range from about +33 to about −28 degrees. Each vane has a convex displacing surface 66 and a concave surface 67, with the opposing parts of the surfaces of each two adjacent vanes defining a channel 68 between them. The channel is confined by a part of the concave surface of one vane and its opposing part of the convex surface of its adjacent vane. The rest of the concave surface freely communicates with the space 69 relatively radially inward of the vanes, and the rest of the convex surface freely communicates with the space 70 relatively radially outward of the vanes. The channel has an inlet 71 communicating with the space relatively radially inward of the vanes, and an outlet 72 communicating with the space relatively radially outward of the vanes. The boundaries of the channel are formed of the opposing parts of the surfaces of the two adjacent vanes and of the two opposing parts of the inner surfaces of the disks related to the channel and confined between the opposing parts of the surfaces of the two adjacent vanes. As shown in FIG. 5 which is a cross sectional view, taken at the plane of line 5-5 in FIG. 4, each channel is formed of two successive freely communicating portions: a first diverging inlet portion 73; and a second constant cross-sectional area outlet portion 74, with the inner surface of the second disk related to the first diverging inlet portion of the channel 75 being sloped, so that the axial width of the first diverging inlet portion of the channel increases gradually from the inlet of the channel 71 towards its second constant cross-sectional area outlet portion 74. Accordingly, the channel diverges from its inlet 71 towards its second constant cross-sectional area outlet portion 74. The opposing parts of the inner surfaces of the disks 76, 77 related to the second constant cross-sectional area outlet portion of the channel, as well as the related opposing parts of the vanes, are parallel to one another, so that the second outlet portion 74 of the channel has constant cross-sectional area.

In operation, the gases in the space 69 relatively radially inward of the vanes are rammed into the channels 68 confined in-between the opposing parts of the surfaces of the circumferentially arranged vanes, and are gradually displaced to the space 70 relatively radially outward of the vanes. Within the channels, the rammed in gases are diverged within the first diverging inlet portions of the channels 73, resulting in a rise in the static pressure energy of the gases, followed by smoothening of the stream of flow of the pressurized gases within the second constant cross sectional area outlet portions of the channels 74, prior to its admission to the space 70 relatively radially outward of the vanes.

The resulting ram pressure rise in this embodiment depends on the speed of the vane leading edges 64, which depends on the rotational speed of the rotor assembly, and its dimensions. The speed of the vane leading edges must be kept within the subsonic range, to avoid the formation of shock waves, which if formed, will interfere with the feeding of the gases to the inlets 71 of the channels 68.

This rotor assembly is convenient for use in the rotary ram compressors wherein other design parameters favor the use of a radially out-flowing compressor arrangement.

Figure 6:
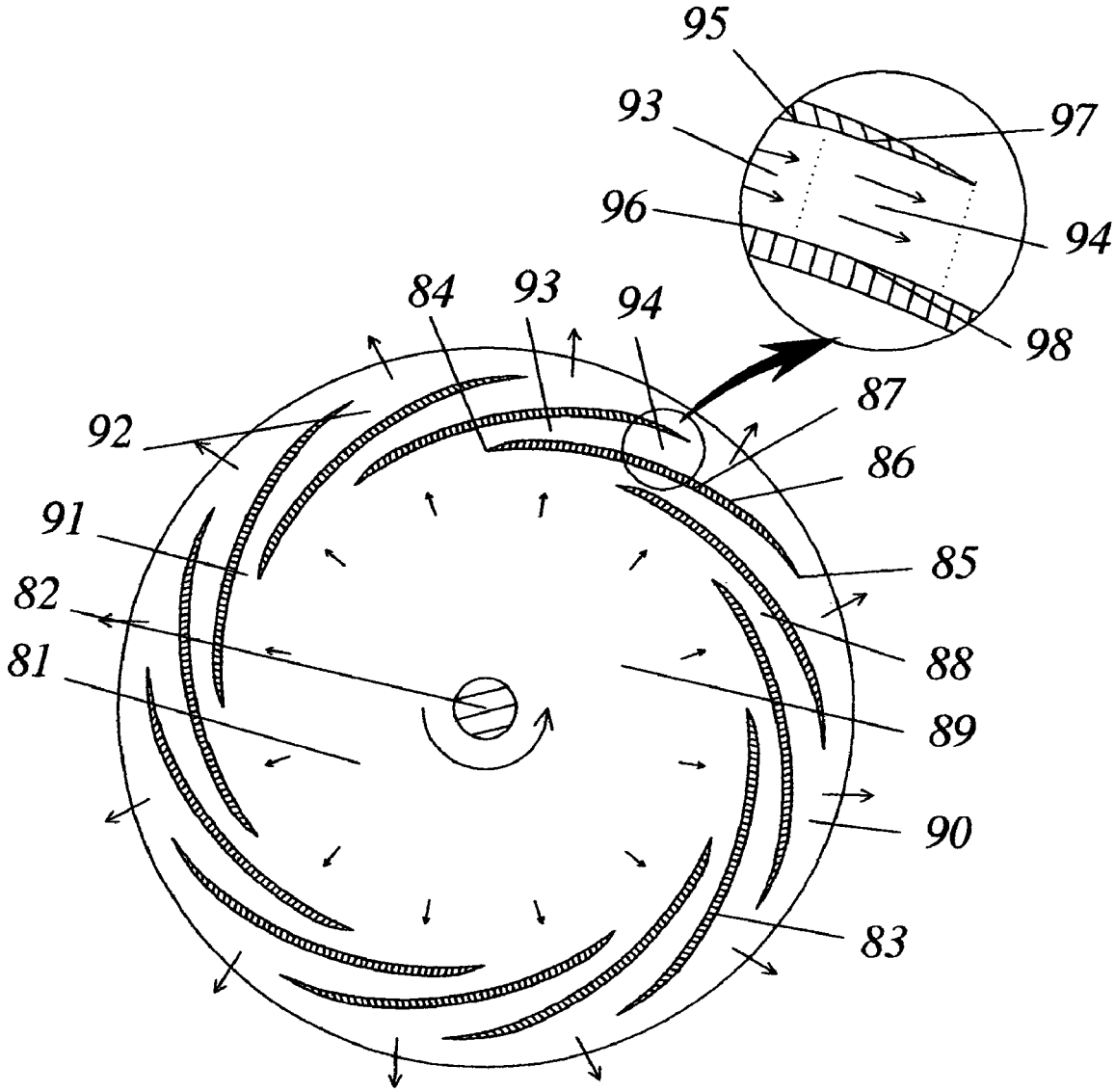
FIG. 6 is a sectional view in a schematic representation of the rotor of another exemplary embodiment of a rotary ram compressor, in accordance with the present invention.

FIG. 6 is a sectional view in a schematic representation of the rotor of another exemplary embodiment of a rotary ram compressor, in accordance with the present invention.

The rotor assembly includes a first disk (not shown in the drawing), a second disk 81 secured for rotation with a drive shaft 82, and a plurality of vanes 83 arranged circumferentially within the annular space defined in-between the relatively inner surfaces of the disks. Each of the circumferentially arranged vanes has a relatively radially inward leading edge or tip 84, and a relatively radially outward trailing edge or tail 85. Each vane is preferably smoothly curved from its leading edge 84 towards its trailing edge 85. The average angles of inclination of the successive portions of the vane with respect to a plane comprising the midpoint of the vane and perpendicular to a radial plane including the rotational axis of the rotor and the midpoint of the vane decreases gradually from its leading edge towards its trailing edge, within a range from about +36 to about −29 degrees. Each vane has a convex displacing surface 86 and a concave surface 87, with the opposing parts of the surfaces of each two adjacent vanes defining a channel 88 between them. The channel is confined by a part of the concave surface of one vane and its opposing part of the convex surface of its adjacent vane. The rest of the concave surface freely communicates with the space 89 relatively radially inward of the vanes, and the rest of the convex surface freely communicates with the space 90 relatively radially outward of the vanes. The channel has an inlet 91 communicating with the space relatively radially inward of the vanes, and an outlet 92 communicating with the space relatively radially outward of the vanes. The boundaries of the channel are formed of the opposing parts of the surfaces of the two adjacent vanes and of the two opposing parts of the inner surfaces of the disks related to the channel and confined between the opposing parts of the surfaces of the two adjacent vanes. Each channel is formed of two successive freely communicating portions: a first diverging inlet portion 93; and a second constant cross-sectional area outlet portion 94, the width between the opposing parts of the surfaces of the two adjacent vanes 95, 96 confining the first diverging inlet portion of the channel 93 between them increase preferably gradually from the inlet of the channel towards its second constant cross-sectional area outlet portion 94. Accordingly, the channel diverges from its inlet 91 towards its second constant cross-sectional area outlet portion 94. The opposing parts of the vanes 97, 98 related to the second constant cross-sectional area outlet portion of the channel are parallel to one another, so that the second outlet portion 94 of the channel has constant cross-sectional area.

In operation, the gases in the space 89 relatively radially inward of the vanes are rammed into the channels 88 confined in-between the opposing parts of the surfaces of the circumferentially arranged vanes, and are gradually displaced to the space 90 relatively radially outward of the vanes. Within the channels, the rammed in gases are diverged within the first diverging inlet portions of the channels 93, resulting in a rise in the static pressure energy of the gases, followed by smoothening of the stream of flow of the pressurized gases within the second constant cross sectional area outlet portions of the channels 94, prior to its admission to the space 90 relatively radially outward of the vanes.

The resulting ram pressure rise in this embodiment depends on the speed of the vane leading edges 84, which depends on the rotational speed of the rotor assembly, and its dimensions. The speed of the vane leading edges must be kept within the subsonic range, to avoid the formation of shock waves, which if formed, will interfere with the feeding of the gases to the inlets 91 of the channels 88.

This rotor assembly is also convenient for use in the rotary ram compressors wherein the other design parameters favor the use of a radially out-flowing compressor arrangement.

FIGS. 7-11 are schematic representations of alternative ways in which the channels confined between the opposing parts of the surfaces of the adjacent vanes of a rotary ram compressor in accordance with the present invention, may be designed.

As discussed herein before, the boundaries of each of the feeding channels are formed of the opposing parts of the surfaces of the two adjacent vanes confining the channel between them (right front and left rear surfaces of the drawings), and of the opposing parts of the disks' surfaces related to the channel and confined between the opposing parts of the surfaces of the two adjacent vanes, with each channel being formed of two successive freely communicating portions: a first diverging inlet portion; and a second constant cross-sectional area outlet portion.

Figure 7:
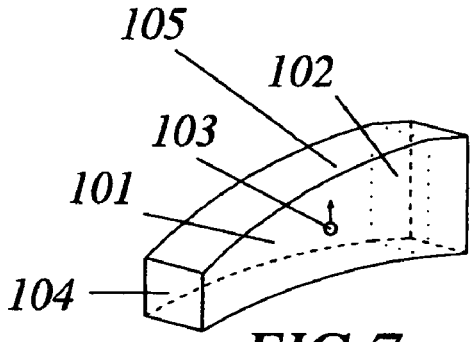
FIGS. 7-11 are schematic representations of alternative ways in which the channels confined between the opposing parts of the surfaces of the adjacent vanes of the rotary ram compressors in accordance with the present invention, may be designed.

In FIG. 7 the divergence of the first inlet portion of the channel 101 is provided by designing the boundaries confining this channel's portion between them so that the axial width 103 of this channel's portion increases gradually from the inlet 104 of the channel towards the second constant cross-sectional outlet portion of the channel 102, with the gradual increase in the axial width provided by designing one 105 of the opposing parts of the disks' surfaces related to this channel's portion and confined between the opposing parts of the surfaces of the two adjacent vanes, so that it is gradually sloping from the inlet of the channel 104 towards its second constant cross-sectional area outlet portion 102.

Figure 8:
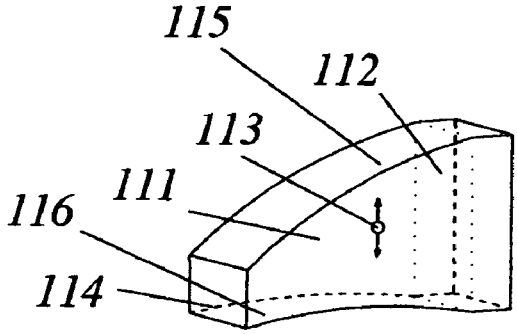

In FIG. 8 the divergence of the first inlet portion of the channel 111 is provided by designing the boundaries confining this channel's portion between them so that the axial width 113 of this channel's portion increases gradually from the inlet 114 of the channel towards the second constant cross-sectional outlet portion of the channel 112, with the gradual increase in the axial width provided by designing both of the opposing parts of the disks' surfaces 115.116 related to this channel's portion and confined between the opposing parts of the surfaces of the two adjacent vanes, so that they are gradually sloping from the inlet of the channel 114 towards its second constant cross-sectional area outlet portion 112.

Figure 9:
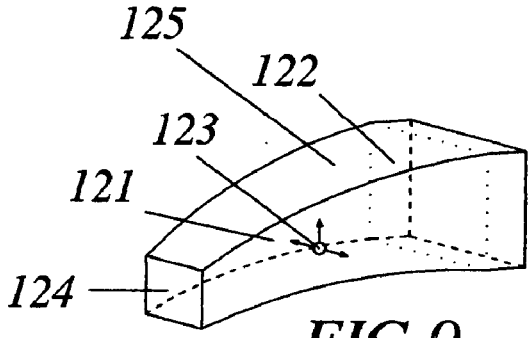

In FIG. 9 the divergence of the first inlet portion of the channel 121 is provided by designing the boundaries confining this channel's portion between them so that both the axial width of this channel's portion and the width between the opposing parts of the surfaces of the two adjacent vanes confining this channel's portion between them 123 increase gradually from the inlet 124 of the channel towards the second constant cross-sectional outlet portion of the channel 122, with the gradual increase in the axial width provided by designing one 125 of the opposing parts of the disks' surfaces related to this channel's portion and confined between the opposing parts of the surfaces of the two adjacent vanes, so that it is gradually sloping from the inlet of the channel 124 towards its second constant cross-sectional area outlet portion 122, and with the gradual increase in the width between the opposing parts of the surfaces of the two adjacent vanes provided by designing the vanes with suitable angles of inclination at their different parts, according to the desired rate of divergence of the channel.

Figure 10:
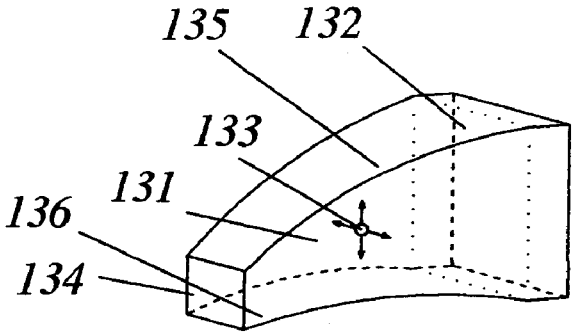

In FIG. 10 the divergence of the first inlet portion of the channel 131 is provided by designing the boundaries confining this channel's portion between them so that both the axial width of this channel's portion and the width between the opposing parts of the surfaces of the two adjacent vanes confining this channel's portion between them 133 increase gradually from the inlet 134 of the channel towards the second constant cross-sectional outlet portion of the channel 132, with the gradual increase in the axial width provided by designing both of the opposing parts of the disks' surfaces 135.136 related to this channel's portion and confined between the opposing parts of the surfaces of the two adjacent vanes, so that they are gradually sloping from the inlet of the channel 134 towards its second constant cross-sectional area outlet portion 132, and with the gradual increase in the width between the opposing parts of the surfaces of the two adjacent vanes provided by designing the vanes with suitable angles of inclination at their different parts, according to the desired rate of divergence of the channel.

Figure 11:
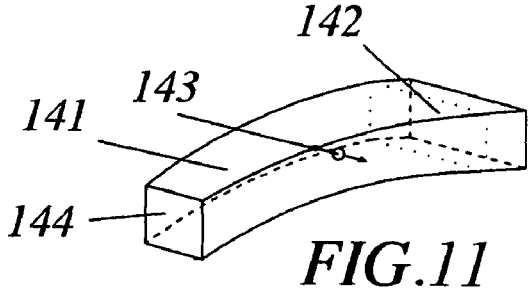

In FIG. 11 the divergence of the first inlet portion of the channel 141 is provided by designing the boundaries confining this channel's portion between them so that the width 143 between the opposing parts of the surfaces of the two adjacent vanes confining this channel's portion between them increases gradually from the inlet 144 of the channel towards the second constant cross-sectional outlet portion of the channel 142, with the gradual increase in the width 143 between the opposing parts of the surfaces of the two adjacent vanes provided by designing the vanes with suitable angles of inclination at their different parts, according to the desired rate of divergence of the channel.

It should be appreciated that the inlet and outlet of each of the channels formed by two adjacent vanes together with the related surfaces of two adjoining disks are radially opposed to each other. By this it is meant that each inlet is disposed at a smaller radial distance from the drive shaft than its corresponding outlet, or that each outlet is disposed at a smaller radial distance from the drive shaft than the corresponding inlet as appropriate when the rotary ram compressor is used respectively to displace gases generally radially outward or generally radially inward. However, it should be appreciated that prior art compressors comprising disks with straight vanes disposed radially and thereby ostensibly having passages with radially opposed inlets and outlets do not suggest the present invention since such devices fail to provide curved channels and fail to utilize the rotary ramming technique herein disclosed. Further it should be understood that a particular embodiment of a rotary ram compressor may comprise disks having vanes disposed to produce both radially inward displacement of gases and radially outward displacement of gases to achieve a desired net result.

Further objectives and advantages of the present invention will be apparent to those skilled in the art from the detailed description of the disclosed invention. The present discussion of illustrative embodiments is not intended to limit the spirit and scope of the invention beyond that specified by the claims presented hereafter.

What is claimed is:

1. A rotary ram compressor comprising:

a stationary casing having at least one inlet passage for admission of gases, and at least one exit passage for discharge of pressurized gases;

a drive shaft supported for rotation in the casing by an arrangement of bearings and extending to a drive receiving end located outside the casing; and a rotor assembly housed inside the casing and including a plurality of axially spaced disks surrounding the drive shaft and lying in planes transverse to the rotational axis of the drive shaft, at least one disk being secured for rotation about the drive shaft, at least two disks defining an annular space in-between with a plurality of vanes arranged circumferentially within the annular space between the two disks, each vane attached to at least one of the two disks defining the annular space, each vane having a leading edge, a trailing edge, a concave surface and a convex surface, the opposing parts of the surfaces of each two adjacent vanes along with the opposing parts of the two disks' surfaces confined between the opposing parts of the surfaces of the two adjacent vanes defining a channel between each two adjacent vanes, each channel having an inlet communicating with the space relatively radially outward of the vanes and an outlet communicating with the space relatively radially inward of the vanes, each channel formed of two successive freely communicating portions: a first diverging inlet portion; and a second constant cross-sectional area outlet portion, with the cross-sectional area of the first diverging inlet portion of each channel increasing from the inlet of the channel to the second constant cross-sectional area outlet portion of the channel.

2. The compressor of claim 1, wherein each vane is smoothly curved from the leading edge to the trailing edge, the angles of inclination of successive portions of each vane decreasing gradually from the leading edge to the trailing edge.

3. The compressor of claim 2, wherein the said angles of inclination range from about +30 to about −48 degrees.

4. The compressor of claim 1, wherein the width between the opposing parts of the surfaces of the two adjacent vanes defining the first diverging inlet portion of the channel between them increases gradually from the inlet of the channel to the second constant cross-sectional area outlet portion of the channel.

5. The compressor of claim 1, wherein at least one of the opposing parts of the disks' surfaces related to the first diverging inlet portion of the channel and confined between the opposing parts of the surfaces of the two adjacent vanes, is sloping such that the axial width of the channel increases gradually from the inlet of the channel to the second constant cross-sectional area outlet portion of the channel.

6. The compressor of claim 1, wherein at least one of the opposing parts of the disks' surfaces related to the first diverging inlet portion of the channel and confined between the opposing parts of the surfaces of the two adjacent vanes, is sloping such that the axial width of the first diverging inlet portion of the channel increases gradually from the inlet of the channel to the second constant cross-sectional area outlet portion of the channel, and wherein the width between the opposing parts of the surfaces of the two adjacent vanes defining the first diverging inlet portion of the channel between them increases gradually from the inlet of the channel to the second constant cross-sectional area outlet portion of the channel.

7. The compressor of claim 1, wherein the plurality of vanes arranged circumferentially within the annular space between the two disks are arranged into a plurality of concentric sets of annularly disposed vanes.

8. The compressor of claim 1, wherein the plurality of axially spaced disks is at least three disks forming at least two axially stacked annular spaces, each stacked annular space having a plurality of vanes arranged circumferentially within.

9. The compressor of claim 8, wherein the plurality of vanes arranged circumferentially within each stacked annular space are arranged into a plurality of concentric sets of annularly disposed vanes.

10. A rotary ram compressor comprising:

a stationary casing having at least one inlet passage for admission of gases, and at least one exit passage for discharge of pressurized gases;

a drive shaft supported for rotation in the casing by an arrangement of bearings and extending to a drive receiving end located outside the casing; and a rotor assembly housed inside the casing and including a plurality of axially spaced disks surrounding the drive shaft and lying in planes transverse to the rotational axis of the drive shaft, at least one disk being secured for rotation about the drive shaft, at least two disks defining an annular space in-between with a plurality of vanes arranged circumferentially within the annular space between the two disks, each vane attached to at least one of the two disks defining the annular space, each vane having a leading edge, a trailing edge, a concave surface and a convex surface, the opposing parts of the surfaces of each two adjacent vanes along with the opposing parts of the two disks' surfaces confined between the opposing parts of the surfaces of the two adjacent vanes defining a channel between each two adjacent vanes, each channel having an inlet communicating with the space relatively radially inward of the vanes and an outlet communicating with the space relatively radially outward of the vanes, each channel formed of two successive freely communicating portions: a first diverging inlet portion; and a second constant cross-sectional area outlet portion, with the cross-sectional area of the first diverging inlet portion of each channel increasing from the inlet of the channel to the second constant cross-sectional area outlet portion of the channel.

11. The compressor of claim 10, wherein each vane is smoothly curved from the leading edge to the trailing edge, the angles of inclination of successive portions of each vane decreasing gradually from the leading edge to the trailing edge.

12. The compressor of claim 11, wherein the said angles of inclination range from about +48 to about −30 degrees.

13. The compressor of claim 10, wherein the width between the opposing parts of the surfaces of the two adjacent vanes defining the first diverging inlet portion of the channel between them increases gradually from the inlet of the channel to the second constant cross-sectional area outlet portion of the channel.

14. The compressor of claim 10, wherein at least one of the opposing parts of the disks' surfaces related to the first diverging inlet portion of the channel and confined between the opposing parts of the surfaces of the two adjacent vanes, is sloping such that the axial width of the channel increases gradually from the inlet of the channel to the second constant cross-sectional area outlet portion of the channel.

15. The compressor of claim 10, wherein at least one of the opposing parts of the disks' surfaces related to the first diverging inlet portion of the channel and confined between the opposing parts of the surfaces of the two adjacent vanes, is sloping such that the axial width of the first diverging inlet portion of the channel increases gradually from the inlet of the channel to the second constant cross-sectional area outlet portion of the channel, and wherein the width between the opposing parts of the surfaces of the two adjacent vanes defining the first diverging inlet portion of the channel between them increases gradually from the inlet of the channel to the second constant cross-sectional area outlet portion of the channel.

16. The compressor of claim 10, wherein the plurality of vanes arranged circumferentially within the annular space between the two disks are arranged into a plurality of concentric sets of annularly disposed vanes.

17. The compressor of claim 10, wherein the plurality of axially spaced disks is at least three disks forming at least two axially stacked annular spaces, each stacked annular space having a plurality of vanes arranged circumferentially within.

18. The compressor of claim 17, wherein the plurality of vanes arranged circumferentially within each stacked annular space are arranged into a plurality of concentric sets of annularly disposed vanes.

* * * * *